US007347645B2

(12) United States Patent
Gregg

(10) Patent No.: US 7,347,645 B2
(45) Date of Patent: Mar. 25, 2008

(54) CONCRETE STAMPING APPARATUS

(75) Inventor: David W. Gregg, Shawnee, KS (US)

(73) Assignee: Rock N Roller, LLC, Oak Grove, MO (US)

( * ) Notice: Subject to any disclaimer, the term of this patent is extended or adjusted under 35 U.S.C. 154(b) by 0 days.

(21) Appl. No.: 11/490,888

(22) Filed: Jul. 21, 2006

(65) Prior Publication Data

US 2006/0257208 A1 Nov. 16, 2006

Related U.S. Application Data

(63) Continuation of application No. 10/932,822, filed on Sep. 2, 2004, now Pat. No. 7,080,955, which is a continuation-in-part of application No. 10/697,364, filed on Oct. 30, 2003, now Pat. No. 7,140,804, which is a continuation-in-part of application No. 10/603,340, filed on Jun. 25, 2003.

(51) Int. Cl.
*E01C 19/43* (2006.01)
*E01C 19/23* (2006.01)
*E01C 19/24* (2006.01)
*E01C 19/26* (2006.01)

(52) U.S. Cl. ..... 404/93; 404/122; 404/129; 404/131

(58) Field of Classification Search ..... 404/122, 404/129, 93, 131
See application file for complete search history.

(56) References Cited

U.S. PATENT DOCUMENTS 519,919 A 5/1894 Maurer
560,684 A * 5/1896 Bunnell ..... 404/129
828,575 A * 8/1906 Schilling ..... 172/545
942,892 A 12/1909 Dunham
1,038,732 A 9/1912 Dunham
1,099,185 A 6/1914 Loveland
1,302,275 A 4/1919 Ashmore et al.
1,744,272 A 1/1930 LePlant et al.
1,955,101 A * 4/1934 Sloan ..... 404/113
2,025,703 A 12/1935 Baily et al.
3,459,108 A * 8/1969 Patterson ..... 404/75
3,910,712 A * 10/1975 Guerin ..... 404/124
3,910,738 A * 10/1975 Chandler et al. ..... 425/162

(Continued)

FOREIGN PATENT DOCUMENTS

FR 2 597 910 A1 4/1986

OTHER PUBLICATIONS

Goldblatt's Catalog and Handy Book 1929, pp. 120-121, 1929 (2 sheets total).

(Continued)

*Primary Examiner*—Raymond W Addie
(74) *Attorney, Agent, or Firm*—Polsinelli Shalton Flanigan Suelthaus PC

(57) ABSTRACT

A concrete stamping apparatus includes a roller with a stamp forming its surface, and a receiving portion for rotatably holding the roller. There is also a system for delivering fluid to release the roller from the surface on which it operates by spraying fluid onto the ground surface in advance of the roller. The receiving portion can be adjustably weighted, such that the roller will stamp the concrete uniformly as the concrete tightens.

20 Claims, 14 Drawing Sheets

U.S. PATENT DOCUMENTS

| | | | | |
|---|---|---|---|---|
| 4,036,126 | A | 7/1977 | Gundersen | |
| 4,184,787 | A | 1/1980 | Uebel | |
| 4,495,738 | A * | 1/1985 | Sheber | 52/204.1 |
| 4,614,486 | A | 9/1986 | Bragagnini | |
| 4,735,567 | A | 4/1988 | Frakes | |
| 4,776,723 | A | 10/1988 | Brimo | |
| 4,828,426 | A | 5/1989 | Hendricks et al. | |
| 5,022,783 | A * | 6/1991 | Jones | 404/122 |
| 5,033,906 | A | 7/1991 | Jordan | |
| 5,222,828 | A | 6/1993 | Magalski | |
| 5,228,799 | A * | 7/1993 | Sondreal | 404/124 |
| 5,346,448 | A | 9/1994 | Sollo | |
| 5,480,259 | A | 1/1996 | Thrower | |
| 5,846,176 | A * | 12/1998 | Zieger et al. | 492/13 |
| 5,887,846 | A | 3/1999 | Hupp | |
| 5,896,929 | A * | 4/1999 | Dori | 172/1 |
| 6,206,611 | B1 | 3/2001 | Schreck | |
| 6,350,083 | B1 | 2/2002 | Paladeni | |
| 6,540,435 | B1 | 4/2003 | Lizarraga | |
| 6,585,451 | B2 * | 7/2003 | Wynings | 404/131 |
| 7,080,955 | B2 | 7/2006 | Gregg | |

OTHER PUBLICATIONS

Quick Imprint Systems, Inc., Brochure, 4 pages.
Quick Imprint Systems, Inc., information sheet entitled: Over 55,000,000 Square Feet Printed In The Past 12 years, 1 page.
Quick Imprint Systems, Inc., information sheet entitled: Save These Important Color Instructions, 1 page.
Quick Imprint Rollers drawing, 1 page.

* cited by examiner

CONCRETE STAMPING APPARATUS

CROSS-REFERENCES TO RELATED APPLICATIONS

This application is a continuation of U.S. patent application Ser. No. 10/932,822 entitled: CONCRETE STAMPING APPARATUS filed Sep. 2, 2004, now U.S. Pat. No. 7,080,955, which is a continuation-in-part of U.S. patent application Ser. No. 10/697,364, entitled: CONCRETE STAMPING APPARATUS, filed Oct. 30, 2003, now U.S. Pat. No. 7,140,804, which is a continuation-in-part of U.S. patent application Ser. No. 10/603,340, entitled: CONCRETE STAMPING APPARATUS, filed on Jun. 25, 2003. U.S. patent application Ser. No. 10/932,822, U.S. patent application Ser. No. 10/697,364 and Ser. No. 10/603,340 are incorporated by reference herein.

TECHNICAL FIELD

The present invention is directed to an apparatus for stamping concrete with patterns, textures, or both.

BACKGROUND OF THE INVENTION

Concrete is a staple in the construction industry. It is a preferred material because of its costs. Concrete is typically poured in slabs. Typically, the poured concrete slabs are given a broom finish pattern, by merely sweeping over the concrete with a broom or the like and letting it harden and dry.

Other finish patterns can be put into concrete, to create other aesthetically pleasing surfaces. These finish patterns are typically "stamped" into the concrete by placing flat mats with patterns over the concrete, tamping the mats, with rods and the like, into contact with the wet concrete, and removing these flat mats.

This method of using the patterned mats is subject to numerous drawbacks. Initially, the amount of concrete that can be worked on in a day is limited. These amounts are typically about 15 yards per pour, three times a day, resulting in about 45 yards per day. Additionally, the tamping for each 15 yard portion takes time. Should other 15 yard portions be poured in parallel, they be tamped later in time, when the concrete is tightened, resulting in a non-uniform pattern being stamped into adjacent portions. Finally, stamping in this manner requires judgement of an experienced, well trained workperson, to judge when the stamping process will be optimal. This is because this kind of stamping can not be performed when the concrete is too wet or alternately, too "tight" or dry.

SUMMARY OF THE INVENTION

The present invention provides apparatus and methods for stamping large volumes of concrete in short time spans, with stamps, of patterns, textures or both. The resultant stamping is uniform over the entire series of concrete slabs. A single apparatus of the invention can be used on concrete when it is both wet and tightening, eliminating the need for switching stamps and/or machinery to achieve uniform stamping as the concrete is worked at different stages of its tightening. The apparatus is easy to operate and can be operated by concrete workers of all skill levels, eliminating errors associated with human judgement as well as the need for skilled concrete stamping personnel. The apparatus is also such that it does not require the preparation and stamping time, as associated with conventional stamping mats, allowing for more yards of concrete to be poured and subsequently stamped in a workday or work session, than with these contemporary methods and devices.

The present invention provides an apparatus, to which weight can be added, to accommodate stamping during the tightening of the concrete. By adding this weight, a uniform stamping can be achieved, with the resultant, stamp, of patterns, textures, or both being uniform among all of the slabs in a series of poured concrete slabs.

The present invention is suitable for stamping concrete that is in an overlay. An overlay is a thin layer of concrete, placed over an existing surface, where only this overlay is worked. The apparatus of the present invention are suitable for working with an overlay, because of its light weight and the stamp on the outer surface of the roller is of a short depth.

An embodiment of the invention is directed to a stamping apparatus. This stamping apparatus includes a roller, the roller including a surface defined by a stamp; and a receiver portion, for example, a support member, for receiving the roller in a rotatable engagement. The receiver portion is configured for weighting the roller. The stamp can include a pattern, a texture, or combinations of patterns and textures.

Another embodiment is directed to a stamping apparatus including a roller received by a receiver portion, for example, a support member. The roller includes a surface defined by a stamp, and the receiver receives the roller in a rotatable engagement, and includes at least one holder for holding removable weights. The stamp includes a pattern, a texture, or combinations thereof.

Another embodiment is directed to a stamping apparatus. This apparatus includes a roller, the roller including a surface of at least one layer including a stamp therein; and a receiver portion for receiving the roller in a rotatable engagement. This receiver portion also includes at least one holder for holding removable weights. The stamp includes a pattern, a texture, or combinations thereof.

Another embodiment is directed to a method for stamping concrete. This method includes providing a stamping apparatus including a roller, the roller including a surface defined by a stamp; and a receiver portion (e.g., a support member) for receiving the roller in a rotatable engagement, the receiver portion configured for weighting the roller; weighting to the receiver portion in accordance with the tightness of the concrete being worked; and moving the apparatus over the concrete being worked for stamping the concrete in accordance with the stamp. The weighting process can include adding, subtracting or simply not adding any weight to the receiver portion. The stamp includes a pattern, a texture, or combinations thereof.

Another embodiment is directed to a method for making a concrete stamp. This method includes providing a mold for a roller having a substantially cylindrical shaped cavity and an inner wall, the inner wall including an imprint corresponding to a stamp; placing material into contact with the inner wall to form a layer that includes a stamp corresponding to the imprint; and filling at least a substantial portion of the remaining cavity with a filler material to form a body for the roller. The roller can then be released from the mold. The imprint for the stamp can include a pattern, a texture or combinations thereof.

Another embodiment is directed to a stamping apparatus having a roller, including a surface defined by a stamp, a receiver portion for receiving the roller in a rotatable engagement, and a fluid transport system. The fluid transport system includes at least one conduit for providing fluid to the roller along the surface. The fluid facilitates release (separation) of the roller from the concrete, and can be for example, water, oil, a water-based composition, an oil-based composition, a petroleum-based composition, or the like. The at least one conduit is typically a single conduit or line that typically branches into sublines, or alternately a single subline. These sublines are configured for extending at least to the receiver portion for providing fluid to the roller along the surface.

Another embodiment is directed to a stamping apparatus having a roller, the roller including a surface defined by a stamp, a receiver portion for receiving the roller in a rotatable engagement, the receiver portion configured for weighting the roller; and a fluid transport system. This fluid transport system includes at least one conduit for providing fluid to the roller along the surface. The at least one conduit is typically a single conduit or line that typically branches into sublines, or alternately a single subline. These sublines are configured for extending at least to the receiver portion for providing fluid to the roller along the surface.

Another embodiment is directed to a method for stamping concrete. This method includes providing a stamping apparatus having a roller, the roller including a surface defined by a stamp, a receiver portion for receiving the roller in a rotatable engagement, and a fluid transport system, the system including at least one conduit for providing fluid to the roller along the surface. The apparatus is then moved over the concrete being worked for stamping the concrete in accordance with the stamp, and typically when needed, the fluid transport system is activated, releasing fluid onto the surface of the roller.

Another embodiment details a method for stamping concrete, where there is provided a stamping apparatus including a roller, the roller including a surface defined by a stamp, a receiver portion for receiving the roller in a rotatable engagement, the receiver portion configured for weighting the roller, and a fluid transport system, the system including at least one conduit for providing fluid to the roller along the surface. The receiver portion is weighted in accordance with the tightness of the concrete being worked, and the apparatus is moved over the concrete being worked for stamping the concrete in accordance with the stamp. Typically, when needed, the fluid transport system is activated, releasing fluid onto the surface of the roller.

Another embodiment of the invention is directed to a stamping apparatus. The stamping apparatus includes, a roller, the roller including a surface defined by a stamp, a receiver portion for receiving the roller in a rotatable engagement, a fluid transport system, the system including at least one conduit for providing fluid for releasing the roller from the surface over which it rides, and, oppositely disposed rods proximate to the opposite ends of the receiver portion. The rods are such that they accommodate weights in at least a plurality of positions on the rods, to adjustably weight the apparatus to control the stamping by the roller.

Another embodiment of the invention is directed to stamping apparatus, that includes a roller, the roller including a surface defined by a stamp, a receiver portion for receiving the roller in a rotatable engagement, and, a fluid dispersing system. The fluid dispensing system includes at least one fluid receiving member with at least one port, through which fluid is discharged, for example, by spraying, for providing fluid for releasing the roller from the surface over which it rides (operates), the fluid receiving member moveable between at least a first position and at least a second position.

Still another embodiment of the invention is directed to a stamping apparatus. The stamping apparatus includes, a roller, the roller including a surface defined by a stamp; a receiver portion for receiving the roller in a rotatable engagement; a fluid dispersing system, and oppositely disposed rods proximate to the opposite ends of the receiver portion. The fluid dispensing system includes at least one fluid receiving member with at least one port, through which fluid is discharged (for example, sprayed), for providing fluid for releasing the roller from the surface over which it rides (operates), the fluid receiving member moveable between at least a first position and at least a second position. The rods accommodate weights in at least a plurality of positions on the rods, to adjustably weight the apparatus to control the stamping by the roller.

Another embodiment of the invention is directed to a method for stamping curing concrete. The method includes, providing an apparatus including, a roller, the roller including a surface defined by a stamp, a receiver portion for receiving the roller in a rotatable engagement, and, a fluid dispersing system, the system including at least one fluid receiving member with at least one port, through which fluid is discharged (sprayed), for providing fluid for releasing the roller from the surface over which it rides (operates). The fluid receiving member is moveable between at least a first position and at least a second position. The at least one fluid receiving member is moved into at least one position where fluid is released in the direction the roller is to be advanced; and the apparatus is moved such that roller contacts the fluid that has been released as the roller advances. The method also includes releasing fluid onto the surface over which the apparatus operates in the direction the roller is advancing.

BRIEF DESCRIPTION OF THE DRAWINGS

Attention is now directed to the attached drawings, wherein like reference numerals indicate corresponding or like components. In the drawings.

DETAILED DESCRIPTION OF THE DRAWINGS

Figure 1:
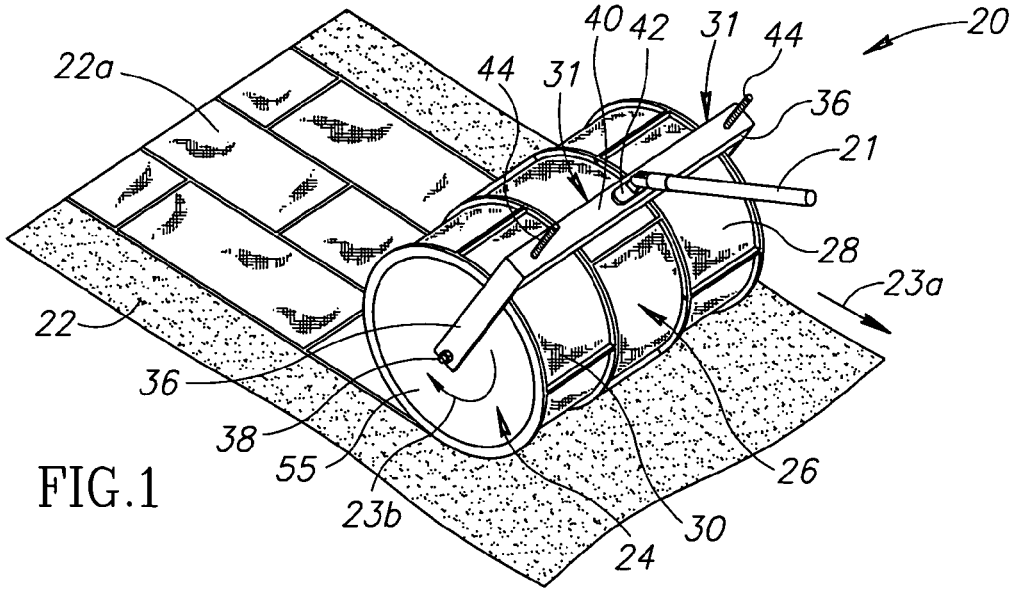
FIG. 1 shows a perspective view of an embodiment of the apparatus of the present invention in use in an exemplary operation also in accordance with the present invention.

FIG. 1 shows the apparatus 20 of the present invention in an exemplary operation. Here, the apparatus 20 is being pulled, as a user (not shown) pulls a handle 21 of the apparatus 20, along a drying (tightening) concrete slab 22 (in the direction of the arrow 23*a*). This movement of the roller 24 causes it to rotate (in the direction of the arrow 23*b*), such that the roller 24, with a stamp or imprint 26 defining its outer surface 28, on a layer 30 of the roller 24, transfers the stamp or imprint 26 to, or "stamps", the concrete 22. Here, a stamp of a pattern and a texture (corresponding to the stamp 26 on the roller 24), for example, that of worn brick, has been stamped into a portion 22*a* of the concrete 22 by the apparatus 20.

Figure 2:
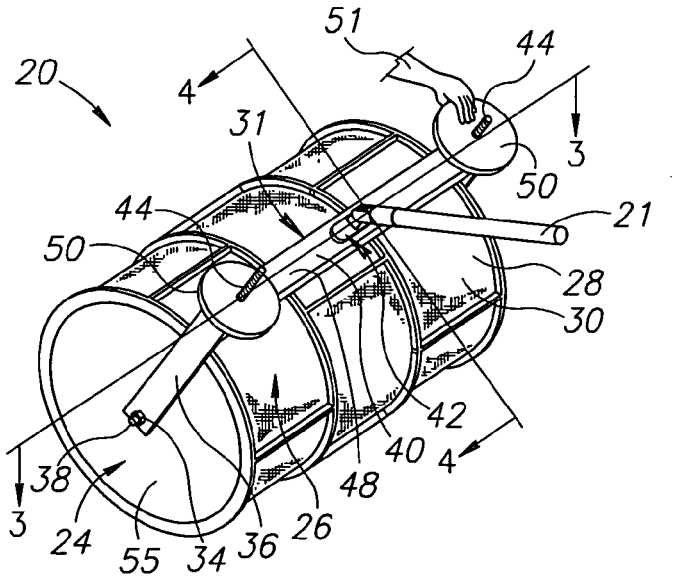
FIG. 2 shows a perspective view of the apparatus of FIG. 1.
Figure 3A:
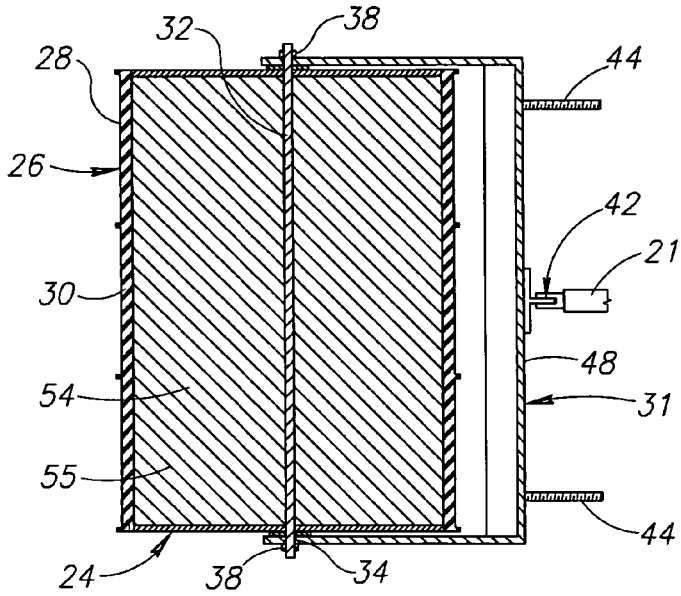
FIG. 3A shows a cross sectional view of the apparatus of FIG. 2, taken along line 3-3 of FIG. 2.

Turning also to FIGS. 2 and 3A, the roller 24 connects to the handle 21 by a support member 31. The roller 24 is rotatably attached to the support member 31 by an axle 32, whose ends are received in openings 34 in lateral members 36 of the support member 31. The axle 32 is maintained in place by bolts 38, caps or the like.

Figure 3B:
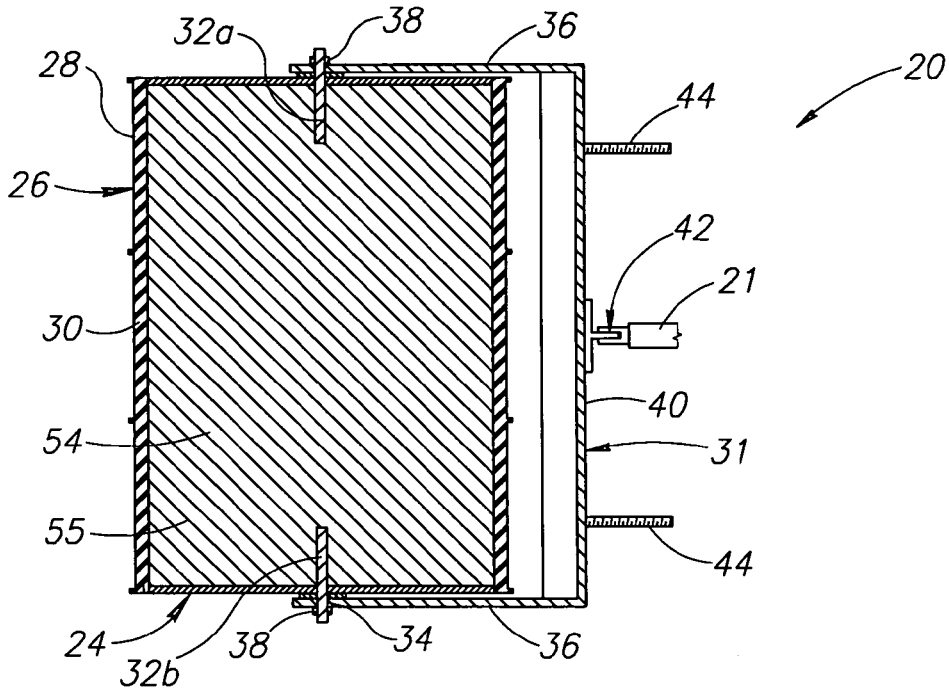
FIG. 3B shows a cross sectional view of an alternate roller for the apparatus of FIG. 2, taken along line 3-3 of FIG. 2.
Figure 4:
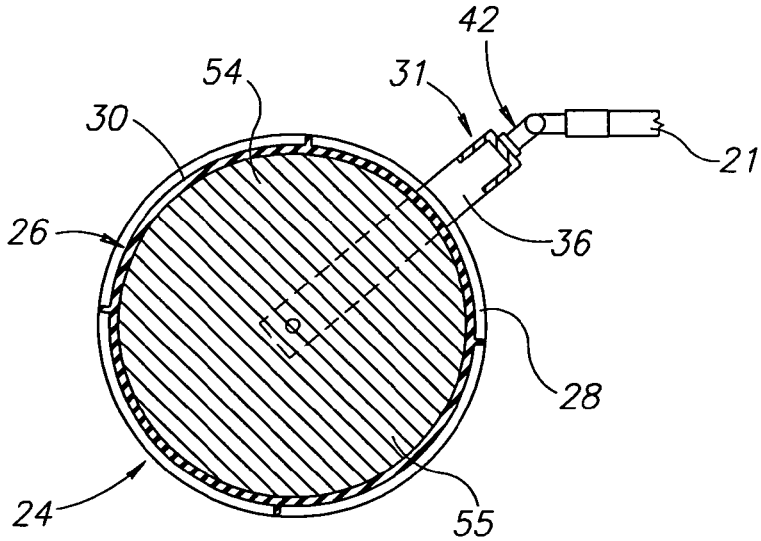
FIG. 4 shows a cross sectional view of the apparatus of FIG. 2, taken along line 4-4 of FIG. 2.

Alternately, as shown in FIG. 3B, the roller 24 can have its axle in two portions 32*a*, 32*b*. These axle portions 32*a*, 32*b* would rotatably attach the roller 24 to the support member 31, as detailed above.

These lateral members 36 are supported by a crossbar 40 of the support member 31. The lateral members 36 and crossbar 40 are typically of metal, such as aluminum, stainless steel or the like. This crossbar 40 typically attaches to the lateral members 36 by bolts, screws or other mechanical type fasteners. Additional securement may be with welds, adhesives and the like. Alternately, the support member 31 may be unitary member, formed of metal, such as aluminum, stainless steel or the like, with the lateral members 36 bent downward from the crossbar 40. A joint 42, typically pivotal, for receiving and engaging the handle 21 is typically attached to the crossbar 40, for example, by conventional fastening structures and methods.

The crossbar 40 itself is of a weight, such that a sufficient imprinting or stamping can be made in wet concrete. The crossbar 40 is also of sufficient strength such that it can support additional weight, that is placed onto it when desired. Weight holders, for example, posts 44, extend from the crossbar 40, that coupled with the surface 48 of the crossbar 40, support weights 50. These weights 50 are such that they can be added or removed by the user (as shown by the hand 51), depending on the dryness (tightness) of the concrete. These weights 50 are typically small weights, with holes in the middle, but other shapes and configurations of weights and corresponding weight holders on the crossbar 40 are also suitable.

This arrangement of weights 50 allows the apparatus 20 to be weighted adjustably, such that the concrete 22 can be imprinted uniformly, even though different portions of the concrete 22 are imprinted when the concrete 22 is at different stages of tightening (hardening). By allowing for adjustable weighting, a single apparatus 20 can be used for the entire area of concrete 22 that has been poured.

The stamp or imprint 26 defining the outer surface 28 of the roller 24 is typically in the layer of material 30. The stamp or imprint 26 is typically a pattern, such as bricks, a texture, such as a worn surface (in relief to various depths), or both (a pattern and a texture, for example, in various combinations), such as worn bricks. The layer of material 30 is typically an elastomeric or polymeric material, one such material being urethane rubber. However, other materials are also suitable, provided they are able to release from concrete, either alone or with the assistance of a release agent or coating.

The material layer 30 may be as thick as desired, provided the desired imprint or stamp 26 is contained therein. This material layer 30 is typically supported by foam 54 or other filling material, that fills the cavity 110 (and accordingly, the interior of the roller 24, defining a body 55 for the roller 24), surrounded by the material layer 30 during manufacturing of the roller 24, as shown in FIGS. 5 and 6 and detailed below.

Figure 5:
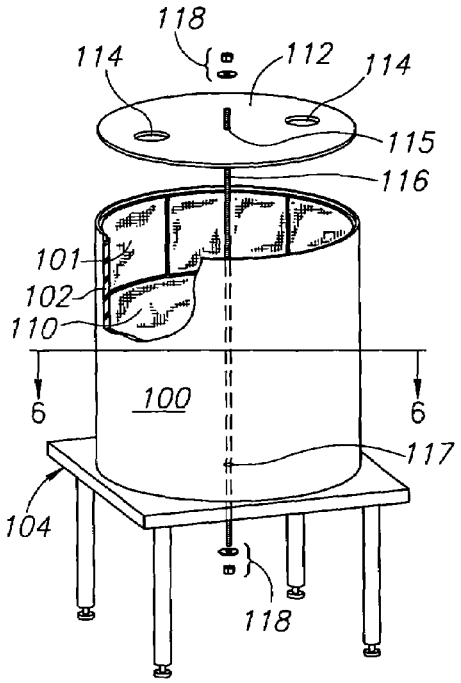
FIG. 5 shows a diagram of a mold and a manufacturing process for the apparatus of FIG. 1 with a portion broken away.
Figure 6:
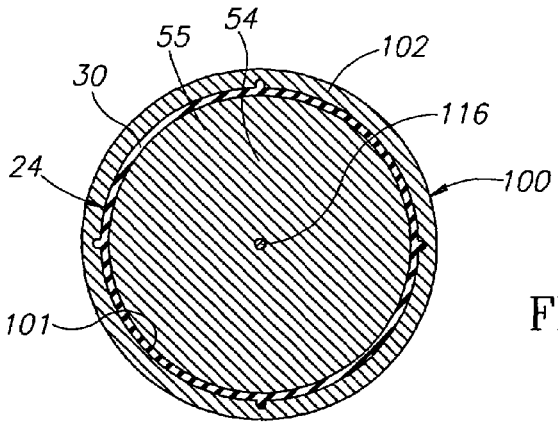
FIG. 6 is a cross sectional view of the mold shown in FIG. 5, taken along line 6-6.

Turning to FIGS. 5 and 6, the apparatus 20 can be made in a mold 100. Here, the mold 100 is, for example, a rubber split mold. This mold 100 includes a surface 101 (along its inner wall 102) corresponding to the desired imprint for the material layer 30, to create the resultant stamp 26 for the roller 24 of the apparatus 20. This mold 100 is such that the resultant imprint or stamp 26 on the material layer 30 of the roller 24 is seamless, such that the stamped concrete has a consistent and uninterrupted pattern.

A leveling stand 104 is placed below the mold 100. The surface 101 of the mold 100 is then coated with a material, typically urethane rubber or other curable material, to the desired thickness, to form the material layer 30 that retains the imprint. The material layer 30, for example, is a rubber layer, that is left to cure. This material layer 30 surrounds a cavity 110 in the mold 100. A cap 112, for fitting over the open end of the mold 100, is placed over the open end of the mold 100, for example in a friction fit. The cap 112 includes openings 114, 115. A rod 116, that becomes the axle 32 in the finished roller 24 is placed into aligned openings 115, 117 (in the leveling stand 104) and temporarily affixed in place by bolt assemblies 118 or other suitable fastening means. Once the rubber has cured, foam is added to the cavity 110 through the openings 114, where it hardens (forming the body 55 for the roller 24). The ends of the now formed roller 24 (FIGS.

1-3A and 4) can be coated with plastic or the like and smoothed over, so as to create a roller 24 with smooth ends.

The alternate roller 24 of FIG. 3B can be made in the mold 100 similarly to that described above. Here, the rod 116 can be omitted, and the opening 117 on the leveling stand 104 is closed. The roller 24 would then be made as detailed above, with axle portions 32*a*, 32*b* placed into the respective ends of the roller 24, by conventional techniques.

Figure 7:
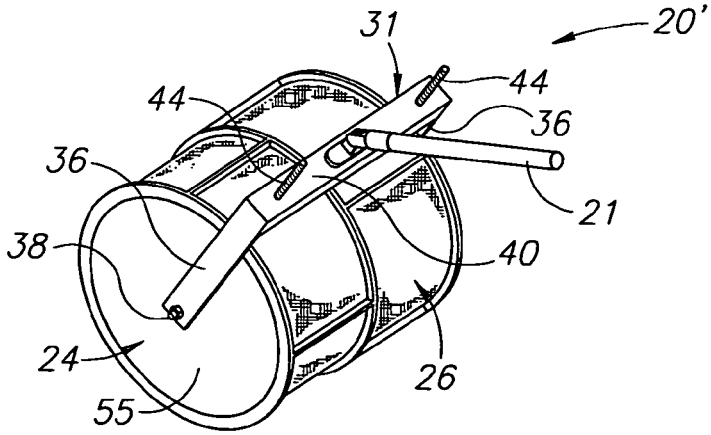
FIG. 7 shows a perspective view of a second embodiment of the apparatus of the invention.

As shown in FIG. 7, an apparatus 20', with a smaller width can be made in accordance with that detailed above. This apparatus 20' is similar in construction and manufacture to the apparatus 20, detailed above, and identical and/or similar components are numbered in accordance with those for the apparatus 20.

Figure 8:
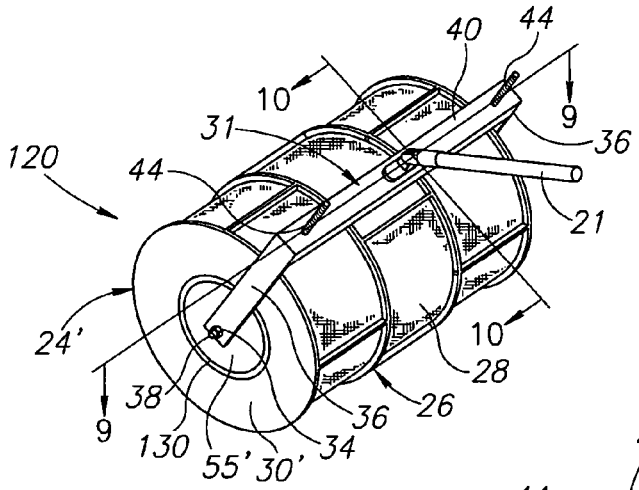
FIG. 8 shows a perspective view of a third embodiment of the apparatus of the invention.
Figure 9:
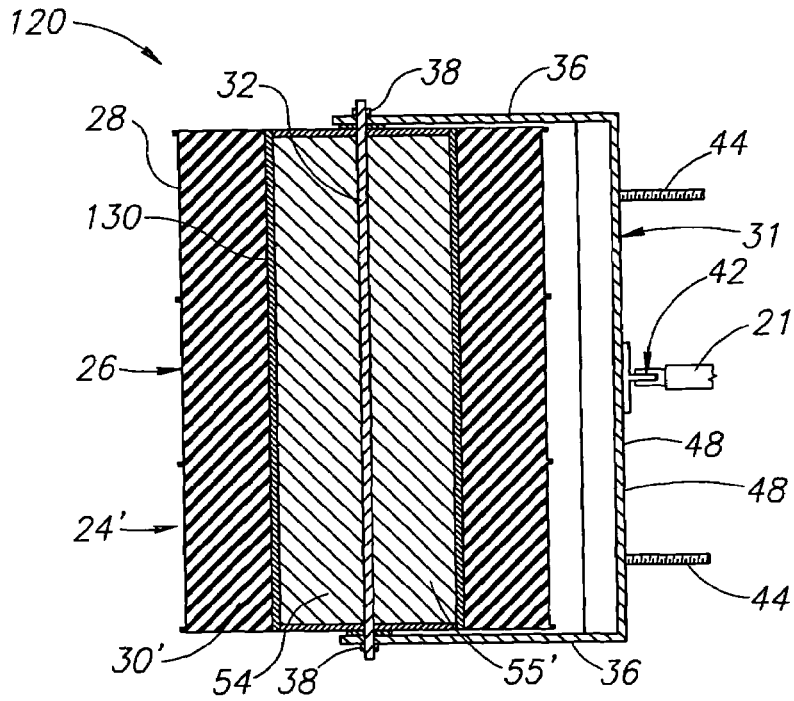
FIGS. 9 and 10 are cross sections of the apparatus of FIG. 8, taken along lines 9-9 and 10-10, respectively.
Figure 10:
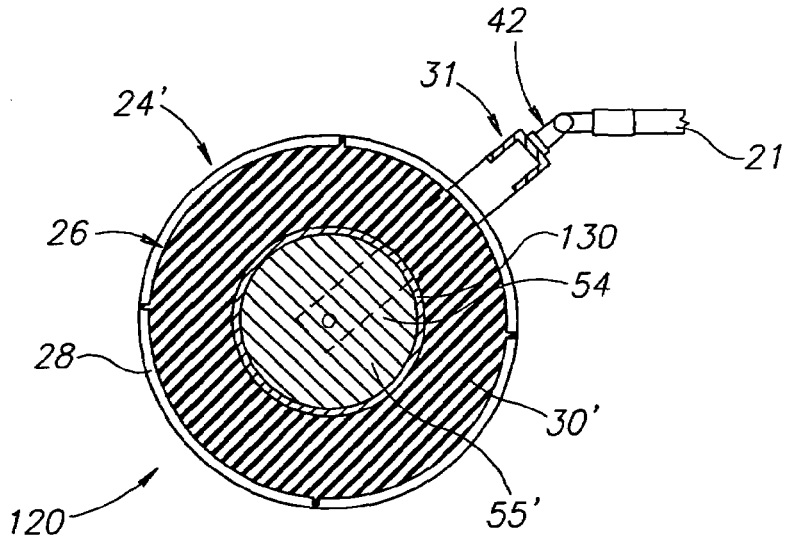

FIGS. 8-10 detail an alternate apparatus 120 having an alternate roller 24', whose material layer 30' is thicker than the material layer 30 of the apparatus 20. While components different than those from the apparatus 20 are indicated as such, identical and/or similar components are numbered in accordance with those for the apparatus 20.

Figure 11:
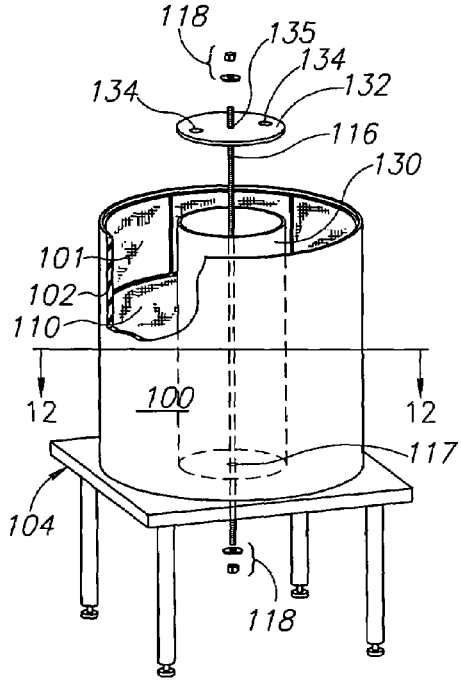
FIG. 11 shows a diagram of a mold and a manufacturing process for the apparatus of FIG. 8 with a portion broken away.
Figure 12:
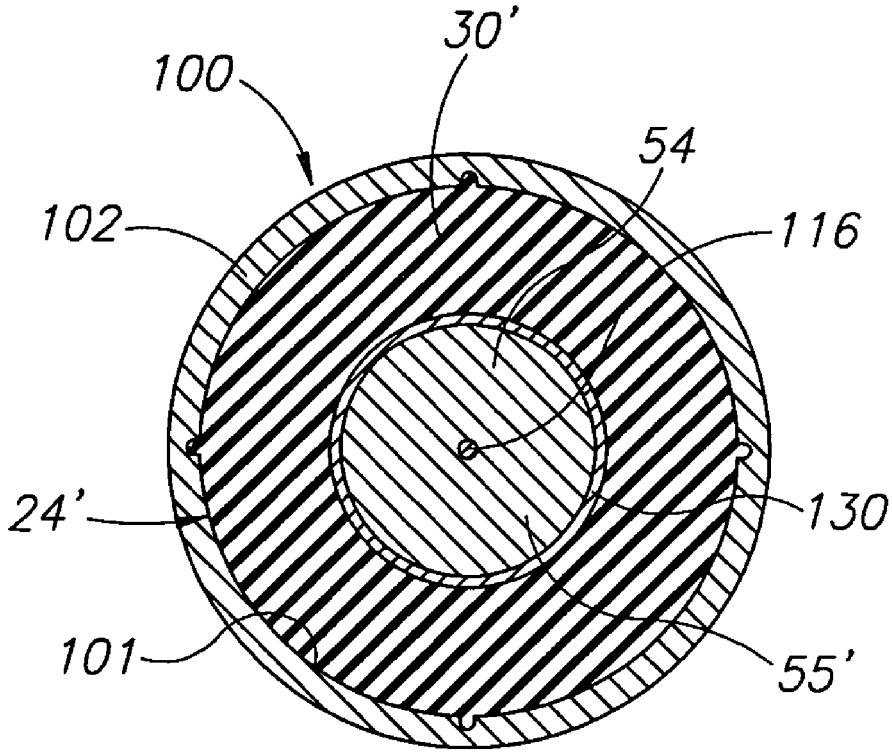
FIG. 12 is a cross sectional view of the mold shown in FIG. 11, taken along line 12-12.

Turning also to FIGS. 11 and 12, the apparatus 120 is, for example, made in the mold 100 of FIGS. 5 and 6, except, a core 130 (or core member), such as a tube or pipe, here for example, a polyvinyl chloride (PVC) pipe, is placed into the cavity of 110 of the mold 100. A cap 132, for fitting over the core 130, with openings 134 (for foam), 135 (for the rod 116, that becomes the axle 32 in the finished roller 24') is typically placed into a frictionally fitting engagement with the core 130 (PVC pipe). The rod 116 is placed into aligned openings 117 (in the leveling stand 104), 135 (in the cap 132), and temporarily affixed in place by bolt assemblies 118 or other suitable fastening means, as detailed above.

Rubber, such as urethane, or other polymeric material, typically that is curable, is then poured into the mold 100, in the space between the surface 101 and the core 130 (PVC pipe). The rubber or other polymeric material then cures, to form the material layer 30' for the roller 24' of the apparatus 20' shown in FIGS. 8-10. The core 130 can then be filled with foam 54 or the like (through the cap opening 134), to form a body 55' for the roller 24', as detailed above. The hardening of the foam 54 or other filler material locks the rod 116 in place.

Alternately, the rod 116 need not be included and the core 130 can be filled as detailed above (with the opening 117 in the leveling stand 104 plugged, as detailed above). Axle portions, such as those 32*a*, 32*b* of FIG. 3B, can be added to the drying or finished roller 24' as detailed above.

Figure 13:
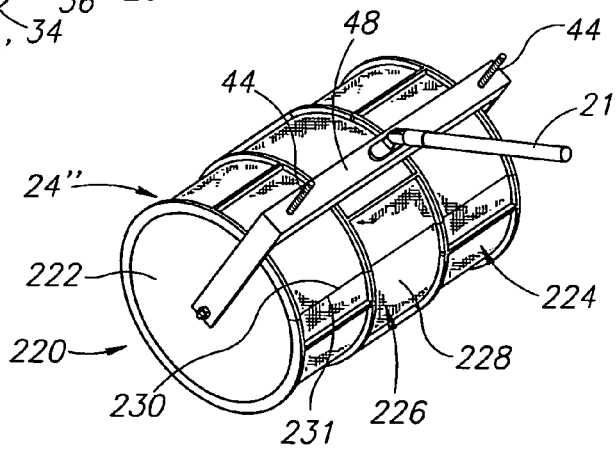
FIG. 13 is a perspective view of a fourth embodiment of the apparatus of the invention.

In an alternate apparatus 220, as shown in FIG. 13, a roller 24" can be made so as to have a smooth surface. This smooth surface can be from a core 222, typically cylindrical or drum shaped or the like, or the aforementioned core coated with a material, such as rubber, plastic or the like. A sheet 224, with the stamp 226 (of a pattern, texture, or both), defining its outer surface 228 can then be attached to a core 222, forming the roller 24". The sheet 224 should be such that its edges 230, 231 match, so as be uniform, avoiding any seams.

Turning back to FIGS. 1-3A and 4, an exemplary operation for the apparatus 20 is now described. This operation includes placing the apparatus 20 onto the poured concrete 22. The apparatus 20 is then pulled in the direction of the arrow 23*a*, such that the roller 24 rotates, leaving an imprint, corresponding to the stamp 26, in a portion of the concrete 22*a*. As the concrete 22 tightens, weights 50 can be added to the apparatus 20, in particular, placed onto the posts 24 of the crossbar 40, such that the imprint into the concrete 22 remains uniform. Weighting (as well as removal of weights 50) continues for as long as desired, depending on the tightness of the concrete 22. This pulling of the apparatus 20 continues until all of the desired concrete area has been stamped.

Alternately, the apparatus 20 can be pushed. In this exemplary pushing mode of operation, the apparatus 20 would function similarly to that described above.

Figure 14:
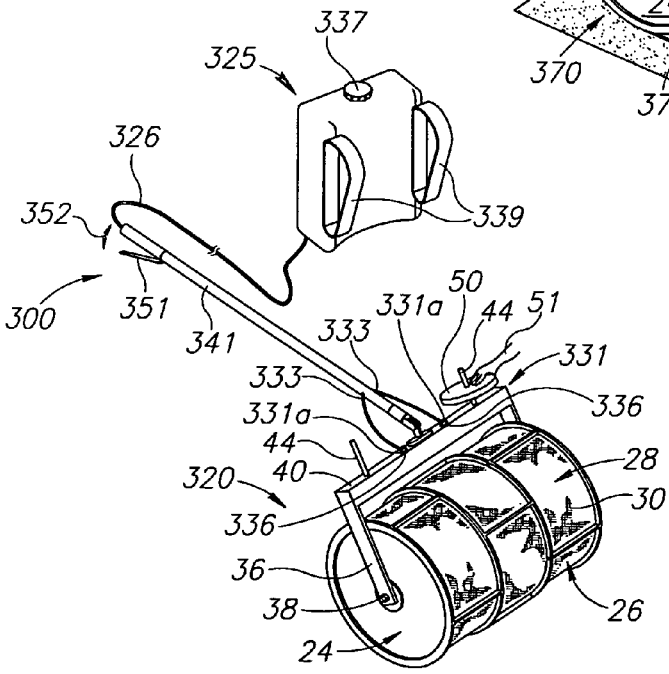
FIG. 14 is a perspective view of a fifth embodiment of the invention.
Figure 15:
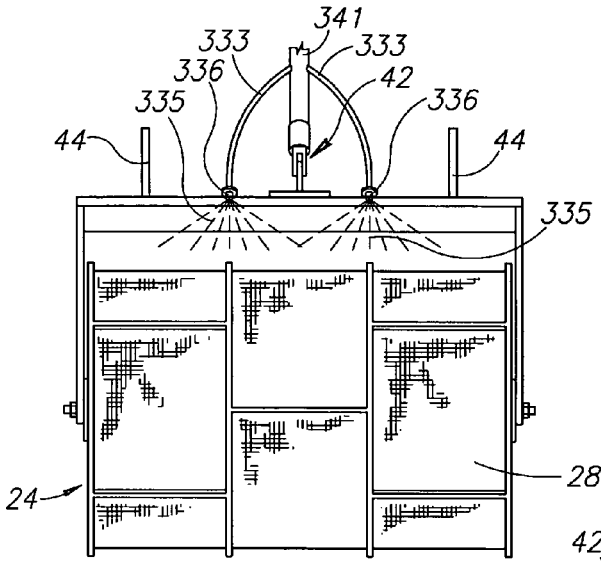
FIG. 15 is a front view of the a portion of the embodiment of FIG. 14.
Figure 16:
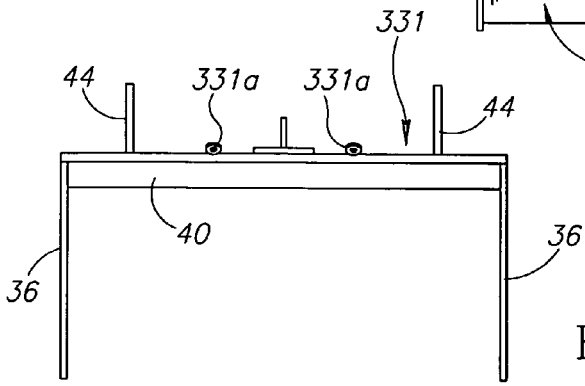
FIG. 16 is a front view of the frame of the embodiment of FIG. 14.

FIGS. 14-16 show an apparatus 300 that is the sixth embodiment of the present invention. The apparatus 300 includes a roller apparatus 320 and a tank 325 or other fluid source connected by a line 326. The roller apparatus 320 is similar to the apparatus 20 (detailed above), and is therefore numbered with the same numbers to indicate identical or like components. The support member 331 is similar to support member 31 detailed above, but also includes rings 331*a* for receiving sublines 333, that branch from the line 326. The support member 331 can also be weighted in the same manner as the support member 31, as detailed above (components are numbered identically).

The sublines 333 are constructed to be retained in the rings 331*a* to extend beyond the support member 331, so as to provide fluid, such as lubricant or release-fluid (typically in a spray stream 335) to the roller 24 (on its surface 28). The sublines 333 typically terminate in spray nozzles 336 or the like, to allow for distribution of the fluid from the tank 325 over the entire roller 24.

Figure 17:
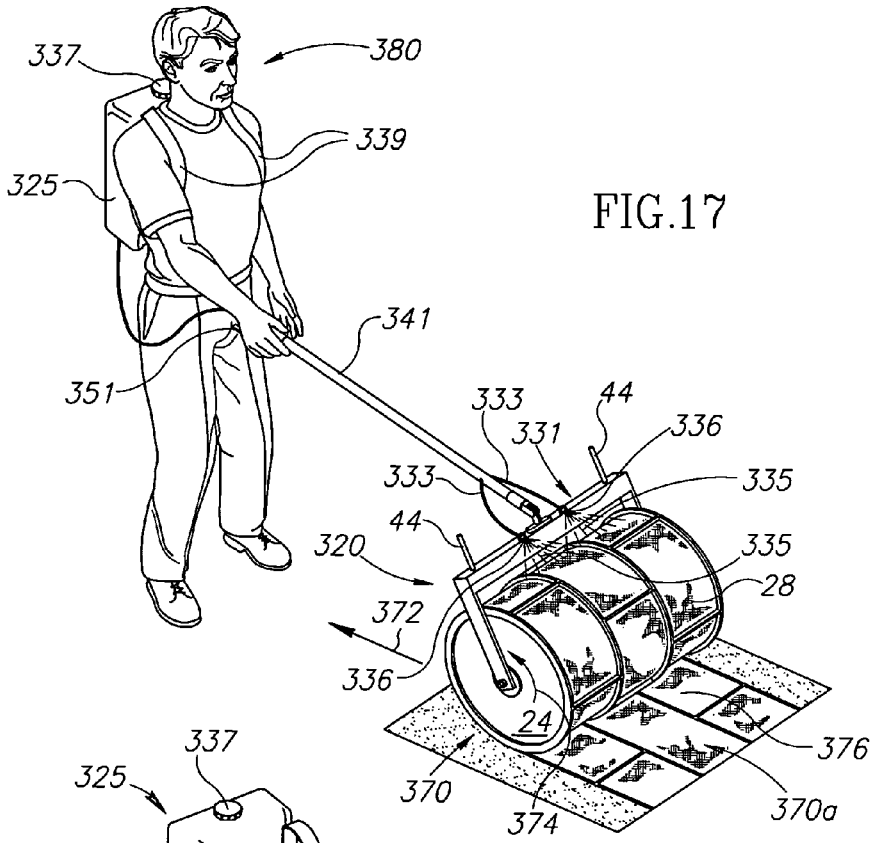
FIG. 17 is a perspective view of the embodiment of FIG. 14 shown in an exemplary operation in accordance with the present invention.

Alternately, the sublines 333 could be positioned so as to release fluid directly onto the concrete 370 (FIG. 17). The sublines 333 could also be positioned to release fluid onto both the surface 28 of the roller 24 and the concrete 370 (FIG. 17).

The tank 325 is typically a vessel, closed by a lid 337 or other similar closure. The tank 325 is typically portable, in the form of a backpack, and includes straps 339 for receiving the arms of a user 360 (FIG. 17). The tank 325 can be filled, and subsequently refilled with fluid. This fluid typically facilitates release (separation) of the roller 24 from the concrete 370 (FIG. 17), and can be fluids such as, release fluid, lubricant or the like, or combinations thereof. For example, these fluids may be water, oil, water-based compositions, oil-based compositions, petroleum-based compositions or the like, or combinations thereof. One suitable fluid is a concrete release agent, commercially available under the name Matt Crete™ Release.

The line 326 extends from the tank 325 through the handle 341 (similar to the handle 21 detailed above, except that it accommodates the line and includes openings 345 for the sub-lines 333). Alternately, a tank need not be used and the line 326 can connect to any other sprayer system.

The handle 341 also supports a grip 351, typically spring biased (movable in accordance with the arrow 352), that activates a pressuring member (not shown), When squeezed inward, toward the handle, pressure is placed on the line 325 by the pressuring member, causing fluid to be released from the sublines 333, onto the roller 24.

Turning to FIG. 17, as well as FIGS. 14-16, an exemplary operation for the apparatus 320 is now described. This operation includes a user 360 placing the tank 325 onto his shoulders and moving the roller apparatus 320 onto the poured concrete 370. The roller apparatus 320 is then pulled in the direction of the arrow 372, such that the roller 24 rotates (in the direction of the arrow 374), leaving an imprint, corresponding to the stamp 376, in a portion of the concrete 370*a*. During the rolling process, the grip 351 is squeezed as necessary, releasing fluid, described above, onto the surface 28 of the roller 24. This allows for an easy release of the roller 24 from the concrete 370.

Although not shown, should a support capable of accommodating weights be used, as the concrete 22 tightens, weights 50 can be added to the apparatus 320. Operation would be similar to that for the apparatus 20 as detailed above. Weighting (as well as removal of weights 50) continues for as long as desired, depending on the tightness of the concrete 370. This pulling of the apparatus 320 continues until all of the desired concrete area has been stamped.

Figure 18:
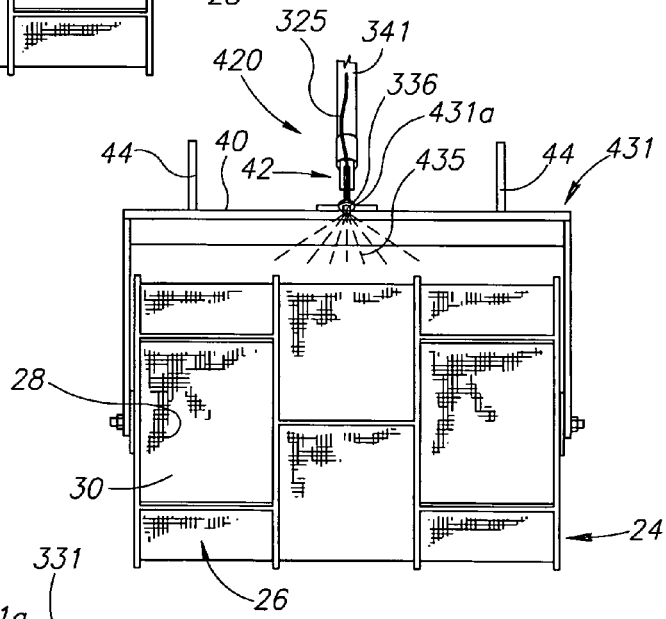
FIG. 18 is a front view of a sixth embodiment of the invention, and in particular, an alternate embodiment of the embodiment of FIGS. 14-17.

Turning now to FIG. 18, there is shown an alternate embodiment roller apparatus 420 for the roller apparatus 320. This apparatus 420 is similar in all aspects to the roller apparatus 320 except that the line 325 remains a single line that is positioned to deposit a single fluid (the fluid detailed above) stream 335 over the roller 24 (on its surface 28). The support member 431 (similar to support members 331 and 31 detailed above) includes a single ring 431*a* for holding the line 325 in a position such that fluid will be released onto the surface 28 of the roller 24. This ring 431*a* is typically centrally positioned on the crossbar 40 of the support member 431, to ensure sufficient and balanced coverage of the surface 28 of the roller 24 by the fluid.

Alternately, the line 325 can be positioned such that it releases the fluid directly onto the concrete 370 (FIG. 17). Also, the line 325 could be positioned such that it releases fluid onto the surface 28 of the roller 24 and onto the concrete 370 (FIG. 17).

Figure 19:
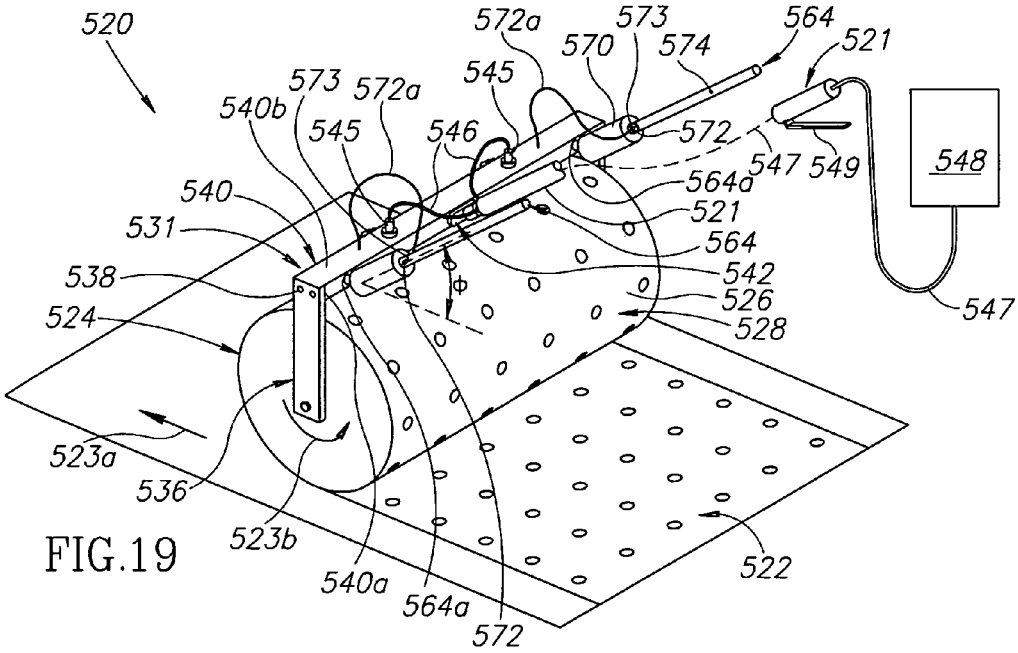
FIG. 19 is a perspective view of a sixth embodiment of an apparatus of the present invention.

Turning now to FIGS. 19-22, there is shown an alternate embodiment apparatus 520 of the present invention, with FIG. 19 showing the apparatus 520 in an exemplary operation. The apparatus 520 is shown, for example, being pushed, as a user (not shown) pushes a handle 521 of the apparatus 520, along a drying (tightening) concrete slab 522 (in the direction of the arrow 523*a*). This movement of the roller 524 causes it to rotate (in the direction of the arrow 523*b*), such that the roller 524, with a stamp or imprint 526 defining its outer surface 528, transfers the stamp or imprint 526 to, or "stamps", the concrete 522. Here, for example, a pattern of outward protrusions has been stamped into the concrete 522. This stamp in the concrete 522 results from the stamp 526 in the roller 524 being corresponding hemispherical indentations 526*a*. While the pattern of indentations is shown, other surface configurations, such as those with patterns and textures, such as that shown for the roller 20 are also suitable for the roller 524.

Figure 20:
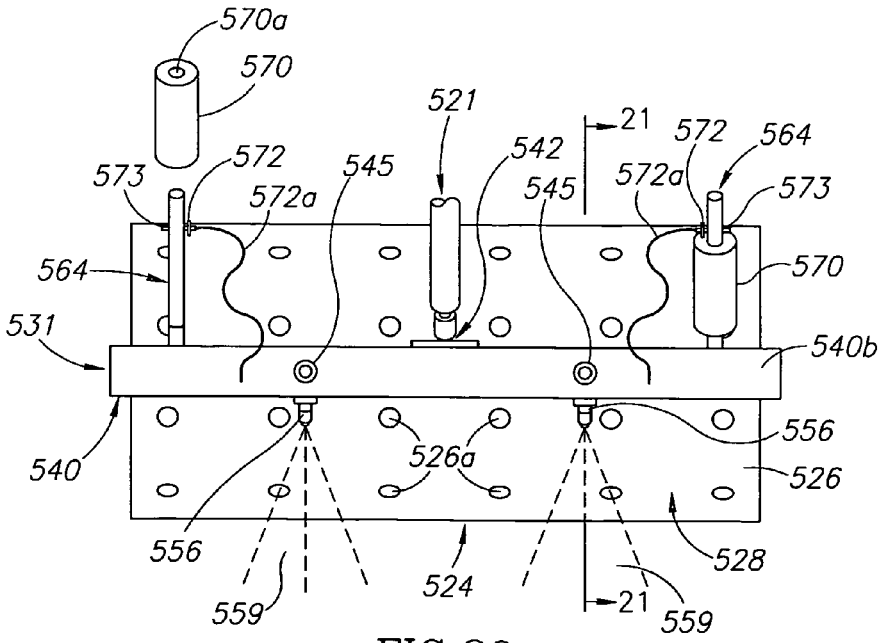
FIG. 20 is a top view of the apparatus of FIG. 19 with the fluid lines removed.
Figure 21:
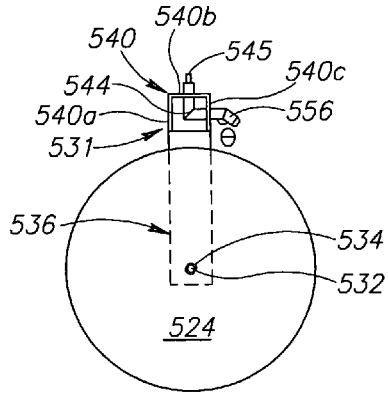
FIG. 21 is a cross-sectional view of the apparatus of FIG. 20, along line 21-21 with the fluid lines removed.
Figure 22:
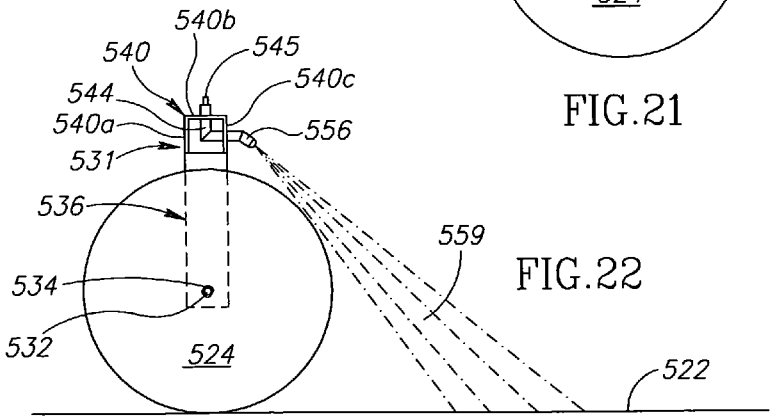
FIG. 22 is a cross sectional view showing the apparatus of FIG. 21 in operation, with the fluid lines removed.

Turning also to FIGS. 20-22, the roller 524 connects to the handle 521 by a support member 531. The roller 524 is rotatably attached to the support member 531 by an axle 532, whose ends are received in indentations 534 in lateral members 536 of the support member 531

These lateral members 536 are supported by a crossbar 540, the lateral members 536 and crossbar 540 defining the support member 531. The lateral members 536 and crossbar 540 are typically of metal, such as aluminum, stainless steel or the like. This crossbar 540 typically attaches to the lateral members 536 by bolts 538, screws or other mechanical type fasteners. Additional securement may be with welds, adhesives and the like. A joint 542, typically pivotal, for receiving and engaging the handle 521 is typically attached to a first lateral side 540*a* of crossbar 540, for receiving the handle 521, in a pivotal attachment. The attachment of the joint 542 to the lateral side 540*a* of the crossbar 540 is, for example, by conventional fastening structures and methods.

A continuous bore 544 extends through the crossbar 540, from the top (top side) 540*b* of the crossbar 540 to a second lateral side 540*c*, defining a pathway for fluid. Heads (or receivers) 545 are typically seated in the bore 544 and extend from the top 540*b* of the crossbar 540, to receive sub lines 546 (similar to sub lines 333), that extend from a main line 547 (similar to line 326) from a tank or other fluid source 548 (similar to the tank 325) of a fluid dispensing system, with fluid dispensed by squeezing a grip 549 of a flow control mechanism at the handle 521 (similar to the grip 351 and associated components detailed above), causing spraying of the fluid upon discharge from the apparatus 520, similar to the fluid dispensing system shown in FIGS. 14-17 and detailed above. The heads 545 typically connect to the crossbar 540 by being threaded and being received by a correspondingly threaded portion of the bore 544 in the crossbar 540.

Nozzles 556 extend from the other end of the bores 544, and provide an outlet for the fluid. The nozzles 556 typically seat in the bore 544, and extend from the second side 540*c* of the crossbar 540. These nozzles 556 typically connect to the crossbar 540 by being threaded and being received by a correspondingly threaded portion of the bore 544 in the crossbar 540.

As shown in FIGS. 21 and 22, the nozzles 556 are typically oriented at an angle θ, such that the fluid (represented by broken lines 559), released through the nozzles 556 (typically being sprayed), into contact with the concrete 522 (the ground surface over which the roller 524 operates), provides a release for the roller 524 (from the concrete 522). The fluid 559 typically contacts the ground surface (concrete) in advance of the roller 524. The angle θ may be, for example, approximately 5° to approximately 55°, with an angle of approximately 45° being typical. Alternately, the nozzles 556 can be oriented at an angle, whereby fluid is released onto the roller 524. Alternately, nozzles 556 can be oriented at an angle, whereby fluid is released partly onto the ground surface and partly onto the roller 524. The fluid that may be used includes the release fluids, lubricants and the like detailed above.

In other alternates, the nozzles 556, as described above, may be on the first lateral side 540*a* of the crossbar 540 (with the second side 540*c* closed), with a corresponding bore extending through the crossbar 540. There may also be nozzles 556 on both lateral sides 540*a*, 540*c* of the crossbar 540, with a corresponding bore in the crossbar 540. The nozzles 556 may be angled as desired, depending if fluid is desired to be sprayed directly onto the ground surface, the roller 524 or portions of both the ground surface and the roller 524. In the case of nozzles 556 on both lateral sides 540*a*, 540*c* of the crossbar 540, valves may also be placed into the bore 544. These valves would be user actuated (manually actuated or remote controlled) to permit fluid egress from any or all of the desired nozzles 546 (on either side 540*a*, 540*c* of the crossbar 540). The valves may be three way valves, to allow for fluid to be dispensed from either of the nozzles along the bore 544, or both of the nozzles along the bore 544.

The crossbar 540 itself is of a weight, such that a sufficient imprinting or stamping can be made in wet concrete. The crossbar 540 is also of sufficient strength such that it can support additional weight, that is placed onto it when desired. Weight holders, for example, rods 564, extend from the crossbar 540, typically from the first side 540*a* of the crossbar 540. The rods 564 fit into openings 564*a* in the crossbar 540. The rods 564 fit into the openings 564*a* in the crossbar 540 by, for example, threaded mechanisms (correspondingly threaded portions of the rod 564 with its respective opening 564*a*), friction fits, welds, combinations thereof, and the like.

The rods 564 are, typically oriented at an angle Φ with respect to the horizontal, sufficient to allow the apparatus 520 to be easily pushed or pulled, and such that the weights 570 will remain proximate to the crossbar 540 (and if not restricted by pins, fall off of the rod 564). For example, angle Φ may be approximately 10° to approximately 70°, with a typical angle being approximately 30°. The rods 564 support weights 570, each weight having a central bore 570*a* therethrough, to be slideable on the rods 564. These weights 570 are held in position by removable pins 572 (each pin 572 typically attached to the crossbar 540 by a line 572*a* or the like) that extend through corresponding openings 573 on the rods 564. The rods 564 include another set of openings 574 to accommodate the pins 572. The weights 570 are typically cylindrical in shape, but other shapes and configurations of weights are also suitable.

The weights are such that they can be added, positioned (for example, below the first opening 573, between the openings 573, 574, or above the opening 574, with the pins 572 in the respective openings 573, 574 to support these positions) or removed by the user. Different ends of the crossbar 540 may be weighted differently, and multiple weights may be placed on one or both of the rods 564. Weighting of the apparatus 520 is adjusted depending on the dryness (tightness) of the concrete to be worked (stamped or imprinted). By weighting the apparatus 520 at the ends of the crossbar 540, the roller 524 is weighted adjustably, such that the concrete 522 can be imprinted uniformly, even though different portions of the concrete 522 may be at different stages of tightening (hardening). By allowing for adjustable weighting of the roller 524, a single apparatus 520 can be used for the entire area of concrete 522 that has been poured.

Figure 23:
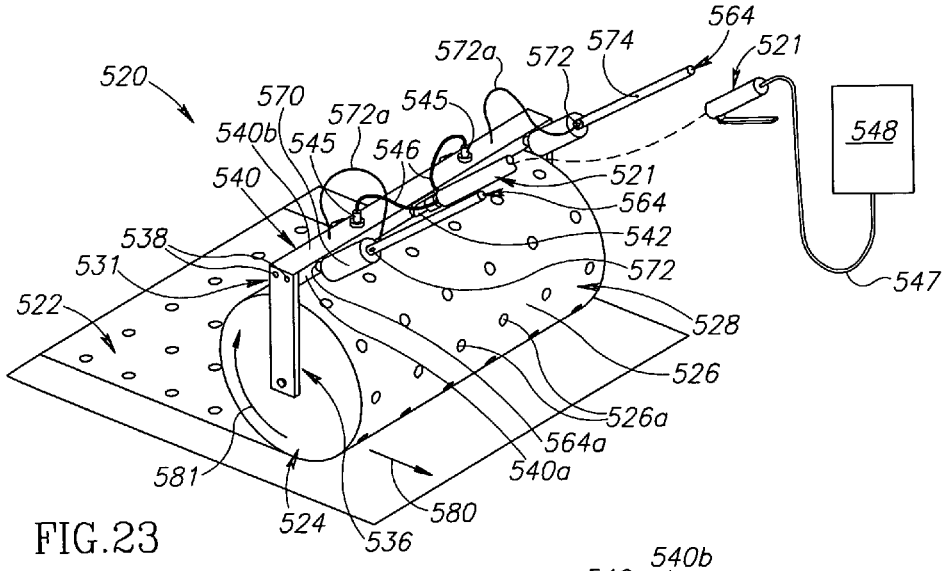
FIG. 23 is a perspective view of the apparatus of FIGS. 19-22 being operated by a user pulling the apparatus.

FIG. 23 details the apparatus 520 in an exemplary operation where it is being pulled. In this figure, the apparatus 520 is being pulled in the direction of the arrow 580, whereby the roller rotates in the direction of the arrow 581. Fluid exits the nozzles (not shown), typically in a spray, behind the roller 524. The concrete 522 is stamped with the imprint of the roller.

Figure 24:
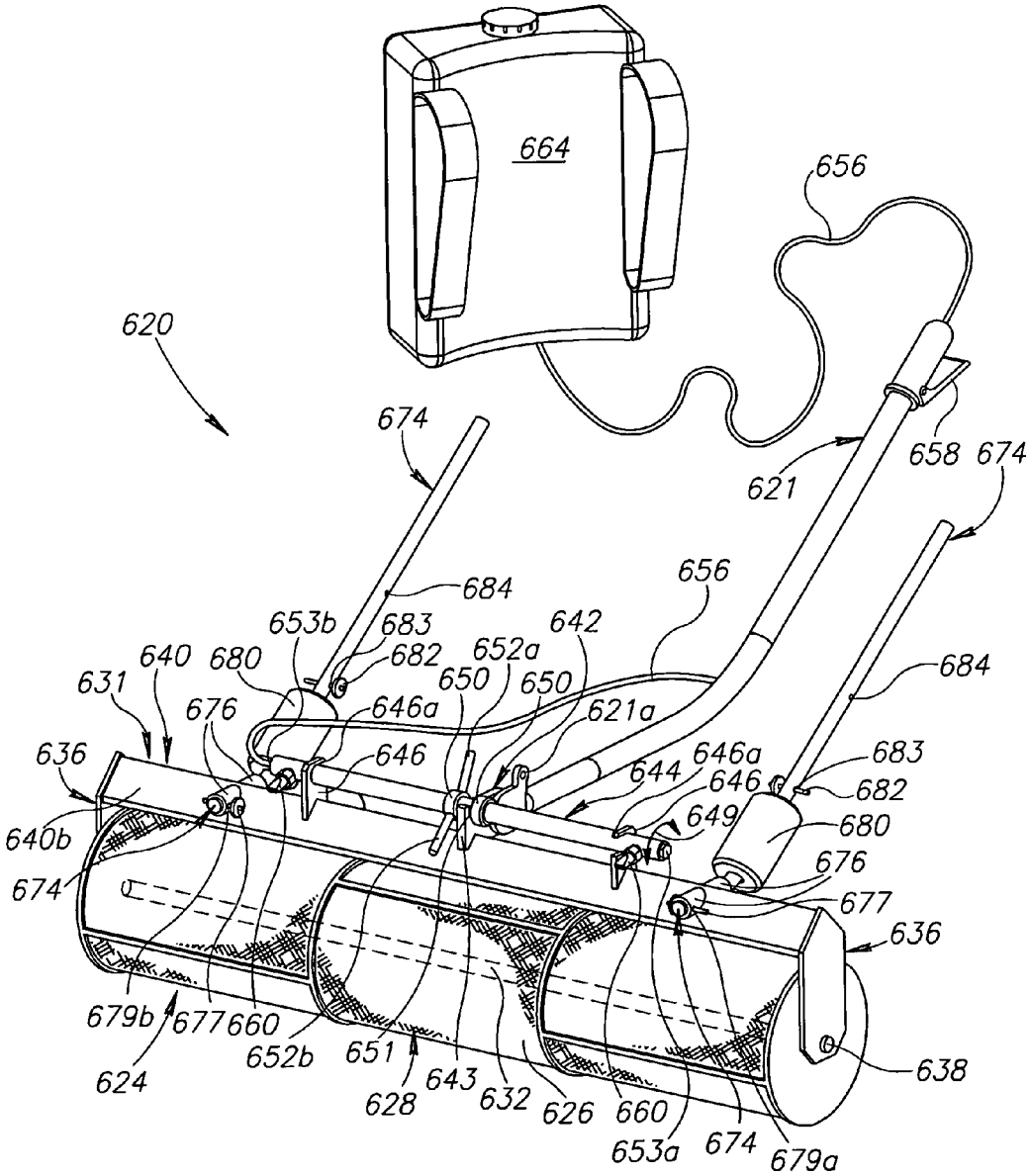
FIG. 24 is a perspective view of a seventh embodiment of an apparatus of the present invention.
Figure 25A:
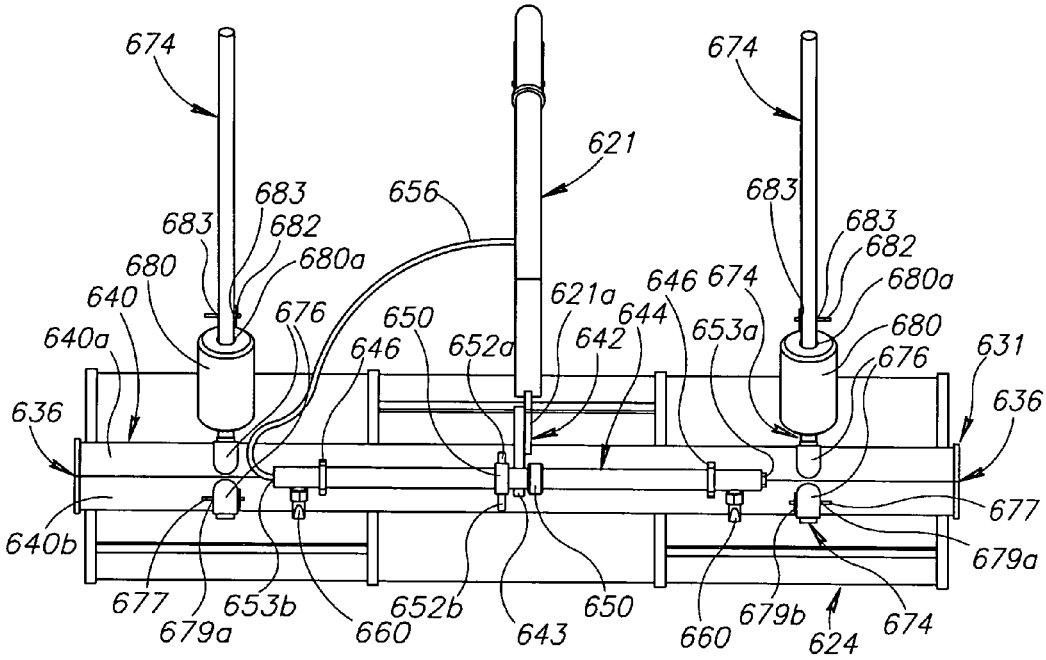
FIG. 25A is a top view of a portion of the apparatus of FIG. 24, with the texture not present.
Figure 26:
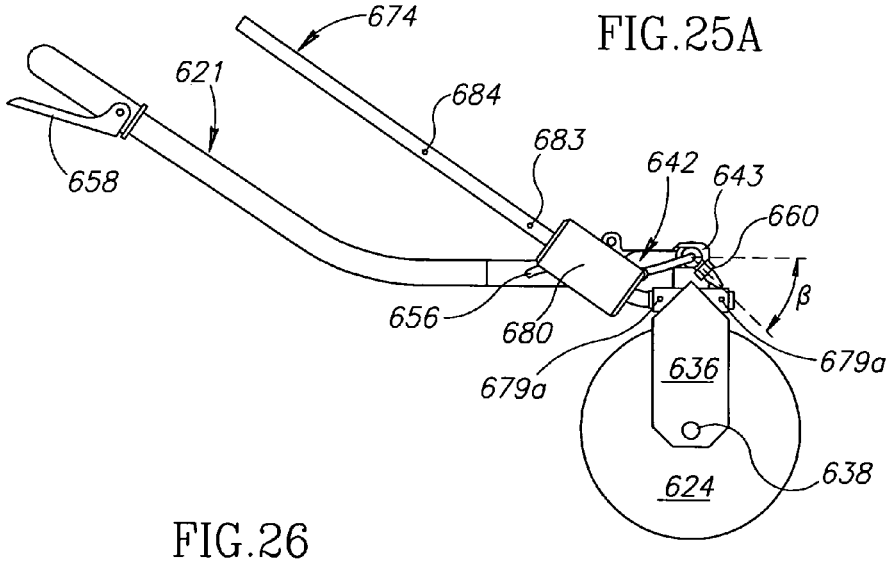
FIG. 26 is a side view of a portion of the apparatus of FIG. 24.

Turning now to FIGS. 24-26, there is shown an alternate embodiment apparatus 620 of the present invention. The apparatus 620 is suitable for use either being pushed or pulled over a slab of curing concrete, for example, similar to the apparatus 20, 520 detailed above. In FIG. 24, the apparatus 620 includes a handle 621 that is pushed or pulled by the user, to move the apparatus 620 (depending on the type of operation). Movement of the apparatus 620 moves a roller 624, similar to roller 24 detailed above, causing it to rotate and transfer a stamp or imprint 626 defining the outer surface 628 of the roller 624 to the concrete. The stamp or imprint 626, for example, is a combined pattern and texture, such as worn brick, with a pattern of brick and a texture of a worn surface in relief. The stamp or imprint 626 is similar to the stamp or imprint 26 of the roller 24 detailed above, and other suitable patterns, textures or combinations thereof are also suitable for use with the roller 624.

The roller 624 connects to the handle 621 by a support member 631. The roller 624 is rotatably attached to the support member 631 by an axle 632, whose ends are received in the lateral members 636 of the support member 631, and are mounted therein by conventional techniques and fasteners, such as bolts 638, caps or the like. The lateral members 636 are supported by a crossbar 640, the lateral members 636 and crossbar 640 defining the support member 631. The lateral members 636 and crossbar 640 are typically of metal, such as aluminum, stainless steel or the like. The crossbar 640 is, for example, v-shaped, so as to have two sides 640*a*, 640*b*. The crossbar 640 typically attaches to the lateral members 636 by bolts, screws, welds or other mechanical type fasteners. Additional securement may be with adhesives and the like.

The handle 621 connects to the crossbar 640 of the support member 631 at a joint 642. The joint 642 is formed by a plate 621*a* of the handle 621, movably, and typically, rotatably, attached, by a bolt or other rotational fastening mechanism, to a portion of a central support 643, the central support attached to the crossbar 640.

Figure 25B:
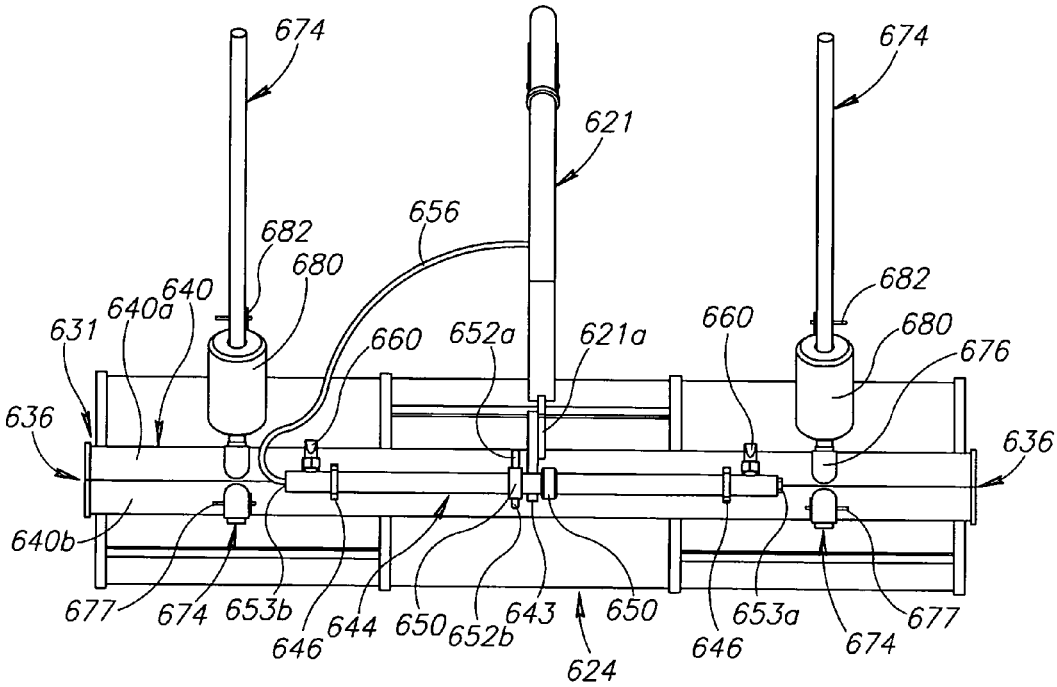
FIG. 25B is a top view of a portion of the apparatus of FIG. 24 with the nozzles oriented opposite to those in FIG. 25A, and the texture not present.

A tube 644 is supported on the crossbar 640 by lateral supports 646, with the central support 643 intermediate the lateral supports 646. The lateral supports 646 are attached to the crossbar 640 similar to the central support 643. As shown in FIGS. 25A and 25B, the tube 644 is rotatable (in the direction of the double headed arrow 649) within the supports 643, 646, and frictionally engaged in the supports 643, 646, so moved only when manual force is applied thereto. The lateral supports 646 are oriented such that their open ends 646*a* are opposite each other, and the tube 644 includes rings 650 attached thereto, with the space between the rings 650 defining a slot 651 where the tube 644 seats in the central support 643, preventing its lateral movement.

At least one of the rings 650 includes protrusions 652*a*, 652*b*, such as bolts or the like, that serve as stops for the rotational movement of the tube 644. The tube 644 is in it maximum rotational position when the corresponding protrusion 652*a*, 652*b* is in abutment with the corresponding side 640*a*, 640*b* of the crossbar 640.

The tube 644 is a hollow member, closed on one lateral side 653*a*, and open on the other lateral side 653*b*, to receive a line 656, hose or the like hose, for supplying fluid to the tube 644. The tube 644 typically includes a plurality of ports (not shown) for fluid discharge from the tube 644. For example, there are two ports in the tube 644, that receive nozzles 660 (for example, that are threadably fitted into the correspondingly threaded ports), through which fluid exits the tube 644. The nozzles 660 are, for example, oriented with respect to each other to be at least substantially collinear and at least substantially parallel to the horizontal, and typically, are collinear with respect to each other and parallel to the horizontal.

For example, in FIG. 25A, with the nozzles 660 oriented away from the handle 621, the protrusion 652*b* is in abutment with the crossbar side 640*b*, whereby the nozzles 660 are oriented as shown in FIG. 26. Alternately, for example, in FIG. 25B, with the nozzles 660 oriented toward the handle 621, the protrusion 652*a* is in abutment with the crossbar side 640*a*. (The nozzles 660 would be angled similar to that shown in FIG. 26, but with the above described orientation). Since the tube 644 is rotatable (as indicated by the double headed arrow 649), such that the nozzles 660 can be oriented on either side 640*a*, 640*b* of the crossbar 640, the apparatus 620 may be pushed or pulled (by the handle 621), with fluid being released (discharged) in front of the roller 624 (onto the concrete or ground surface), onto the leading side of the roller 624, or parts of both, in the direction that the roller 624 is advancing.

When the apparatus 620 is in operation, for example, the nozzles 660, and accordingly, the tube 644, are oriented such that fluid is sprayed in the direction that the roller 624 is advancing. By spraying fluid in the advancing direction, the roller 644 can release easily from the concrete being worked. The nozzles 660 are, for example, oriented to spray fluid onto the concrete or ground surface (in advance of the roller 624). As shown in FIG. 26, the nozzles 660 are typically oriented at an angle β, with respect to the horizontal, so as to spray fluid onto the concrete (ground surface). However, the nozzles 660 may also be oriented to spray fluid onto the roller 624 (the leading side) or both the roller 624 and the concrete. The angle β may be, for example, approximately 45°.

Alternately, for example, with the apparatus 620, the fluid could be released behind the roller 624, or onto the roller 624 at its trailing side, if desired.

The line 656 (similar to the line 326 described above) receives fluid from a tank 664 or other fluid source (portable or non-portable). The tank 664 may be a backpack or the like, and is similar to the tank 325 detailed above. Fluid flow through the line 656 is controlled by a gripping mechanism 658, that activates a pressuring member (not shown) for creating fluid spraying, similar to the grip 351 and pressuring member shown in FIGS. 14-17, and detailed above. The fluids used are also the release fluids, lubricants and the like, as detailed above.

The crossbar 640 itself is of a weight, such that a sufficient imprinting or stamping can be made in wet concrete. The crossbar 640 is also of sufficient strength such that it can support additional weight, that is placed onto it when desired. Weight holders, for example, removable rods 674, fit into tubes 676 that extend through openings in the respective sides 640*a*, 640*b* of the crossbar 640. The rods 674 are retained in position, by pins 677 that extend through aligned openings 679*a*, 679*b* in the tubes 676 and rods 674 (openings not shown in rods 674).

The rods 674, are similar to the rods 564 described above, as they also support weights 680 (similar to the weights 570 described above) with a central bore 680*a* therethrough, to be slideable on the rods 674. The rods 674 are typically oriented at an angle with respect to the horizontal, sufficient to allow the apparatus 620 to be easily pushed or pulled, and such that the weights 680 will remain proximate to the crossbar 640 (and if not restricted by pins, fall off of the rod 674). This angle is similar to angle Φ shown in FIG. 19 and detailed above.

The weights 680 are held in position by removable pins 682, that extend through corresponding openings 683 on the rods 674. The rods 674 include another set of openings 684 to accommodate the pins 682, or additional pins. The weights 680 are typically cylindrical in shape, but other shapes and configurations of weights are also suitable.

The weights 680 are such that they can be added, positioned (for example, below the first opening 683, between the openings 683, 684, or above the opening 684, with the pins 682 in the respective openings 683, 684 to support these positions) or removed by the user. Different ends of the crossbar 640 may be weighted differently, and multiple weights may be placed on one or both of the rods 674. Weighting of the apparatus 620 is adjusted depending on the dryness (tightness) of the concrete to be worked (stamped or imprinted). By weighting the apparatus 620 at the ends of the crossbar 640, the roller 624 is weighted adjustably, such that the concrete can be imprinted uniformly, even though different portions of the concrete may be at different stages of tightening (hardening). By allowing for adjustable weighting of the roller 624, a single apparatus 620 can be used for the entire area of concrete that has been poured.

Figure 27:
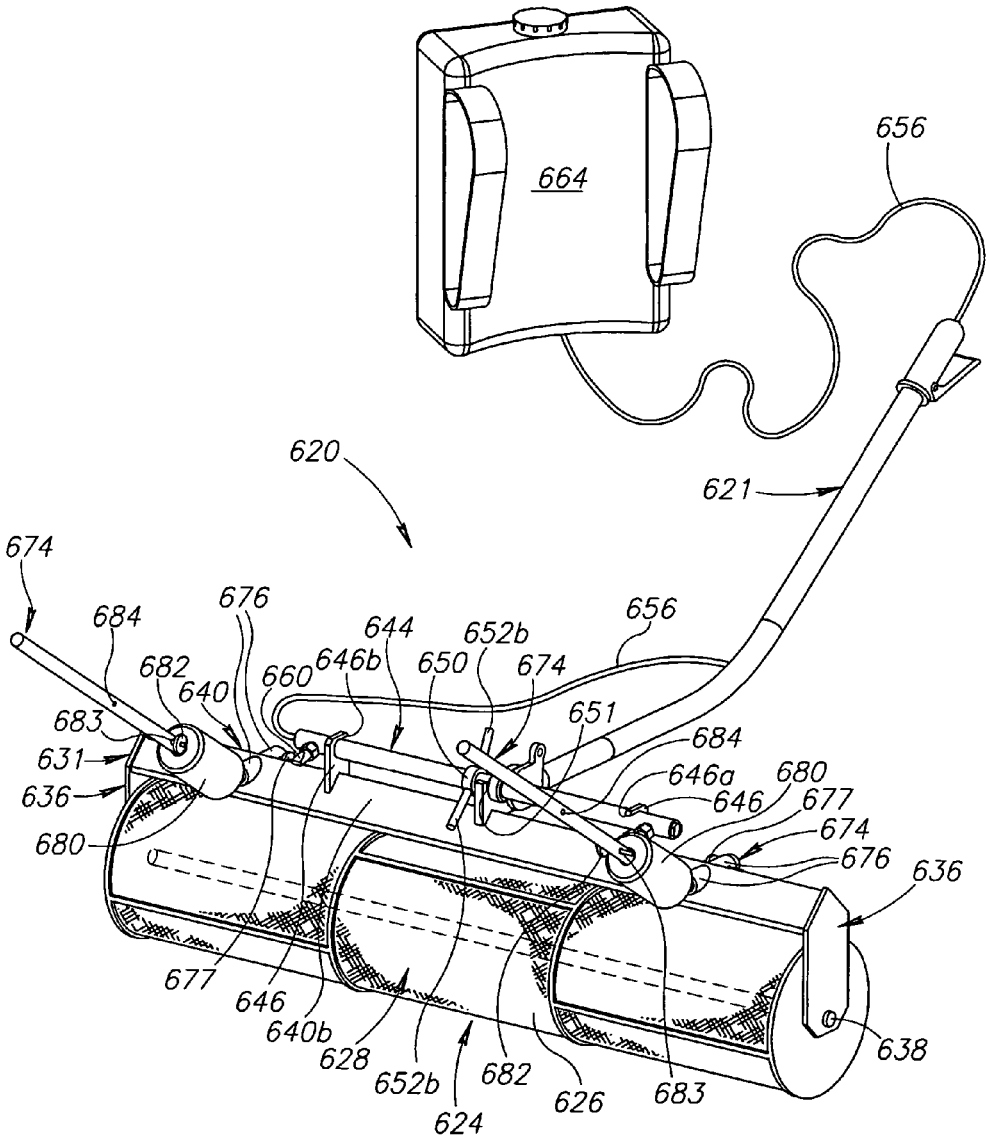
FIG. 27 is a perspective view of the apparatus of FIG. 24 with the weight rods in an alternate position.

FIG. 27 shows the apparatus 620 where the orientation of the rods 674 has been switched, to the opposite side of the apparatus 620. The rods 674 extend from side 640*b* of the crossbar 640. The rods 674 are secured by pins 677, that extend through aligned openings in the rods 674 and tubes 676, as detailed above, on the opposite side 640*a* of the crossbar 640. The tube 644, and therefore, the nozzles 660 can also be reoriented if desired, depending on the desired direction of movement for the roller 624. By orienting the rods 674 in this manner, away from the handle 621, the rods 674 also serve as a handle in that they may be gripped by a worker to lift the apparatus 620 to the next location to be worked.

Thus, there has been shown and described apparatus and processes for stamping concrete It is apparent to those skilled in the art, however, that many changes, variations, modifications, and other uses and applications for the above described embodiments are possible, and also such changes, variations, modifications, and other uses and applications which do not depart from the spirit and scope of the invention are deemed to be covered by the invention, which is limited only by the claims which follow.

What is claimed is:

1. An apparatus for stamping wet concrete comprising:

a roller, the roller including a surface defined by a stamp having a pattern or a texture;

a receiver portion for receiving the roller in a rotatable engagement;

a fluid transport system connected to the stamping apparatus, the system including at least one conduit for providing fluid for releasing the roller from the surface over which it rides;

weight holders extending from the receiver portion, wherein the weight holders receive a plurality of weights, to adjustably weight the apparatus to control the stamping by the roller, in accordance with the tightness of the wet concrete being worked, wherein the weight holders are on opposite sides of the receiver portion, wherein the weight holders comprise rods that extend from the receiver portion at an angle of approximately 10 degrees to approximately 70 degrees, wherein the weights have holes that receive the rods.

2. The apparatus of claim 1, wherein the rods form handles.

3. The apparatus of claim 1, wherein the fluid transport system includes a fluid source in communication with the at least one conduit.

4. The apparatus of claim 3, wherein the fluid source includes a portable tank.

5. The apparatus of claim 1, wherein the fluid transport system includes an activatable mechanism for discharging fluid from the at least one conduit, the activatable mechanism in communication with the at least one conduit.

6. The apparatus of claim 1, wherein the weight holders are oppositely disposed rods proximate to the opposite ends of the receiver portion, the rods configured for accommodating weights in at least a plurality of positions on the rods, to adjustably weight the apparatus to control the stamping by the roller.

7. The apparatus of claim 6, wherein the rods are removable from the opposite ends of the receiver portion, the receiver portion further comprising a handle, wherein the rods are orientated away from the handle.

8. The apparatus of claim 1, wherein the fluid transport system includes a tube rotatably mounted in communication with the receiver portion, the tube configured for communication with a fluid source.

9. The apparatus of claim 8, wherein nozzles are in communication with the tubes, and the nozzles are oriented to provide fluid to the ground surface proximate to the roller or to the roller.

10. The apparatus of claim 9, wherein the receiver comprises a handle, wherein the rods have positions on a first and a second side of the receiver, wherein the rods extend from the first side of the receiver toward the handle or the second side of the receiver away from the handle.

11. An apparatus for stamping wet concrete comprising:

a roller, the roller including a surface defined by a stamp having a texture or a pattern;

a receiver portion for receiving the roller in a rotatable engagement;

a fluid dispersing system, the system including at least one fluid receiving member with at least one port, through which fluid is discharged, for providing fluid for releasing the roller from the surface over which it rides, the fluid receiving member in a rotatable engagement with the receiver portion, the fluid receiving member rotatable relative to the receiver portion between at least a first position and at least a second position to discharge fluid in at least two directions; and, weight holders proximate to the opposite ends of the receiver portion, the weight holders configured for accommodating a plurality of weights, to adjustably weight the apparatus to control the stamping by the roller.

12. The apparatus of claim 11, wherein the weight holders are rods that are removable from the opposite ends of the receiver portion.

13. The apparatus of claim 11, wherein the fluid receiving member includes a tube rotatably mounted in communication with the receiver portion, the tube configured for communication with a fluid source.

14. The apparatus of claim 13, wherein the tube includes at least two ports, at least substantially collinear with each other, the at least two ports in communication with nozzles.

15. The apparatus of claim 14, wherein the nozzles are oriented to provide fluid to the ground surface proximate to the roller or to the roller.

16. The apparatus of claim 11, wherein the fluid dispensing system additionally comprises:

a conduit for communication with a fluid source and the at least one fluid receiving member and an activatable mechanism for controlling fluid flow through the conduit for discharge through the at least one port.

17. The apparatus of claim 16, wherein the fluid dispensing system additionally comprises a fluid source in communication with the conduit.

18. The apparatus of claim 17, wherein the fluid source includes a portable tank.

19. A method for stamping curing concrete comprising:

providing an apparatus comprising:

a roller, the roller including a surface defined by a stamp;

a receiver portion for receiving the roller in a rotatable engagement; the receiving portion having a weight holder that receives a plurality of weights; wherein the weight holder is a rod that extends from the receiver portion; and, a fluid dispersing system, the system including at least one fluid receiving member with at least one port, through which fluid is discharged, for providing fluid for releasing the roller from the surface over which it rides;

moving the apparatus such that roller contacts the fluid that has been released as the roller advances;

adding at least one weight to the weight holders; and using the weight holder as a handle to lift the apparatus to the next location to be worked.

20. The method for stamping curing concrete according to claim 19, further comprising adding or removing at least one weight to or from the weight holders.

* * * * *